US009482107B2

(12) United States Patent
Batt

(10) Patent No.: US 9,482,107 B2
(45) Date of Patent: Nov. 1, 2016

(54) GAS TURBINE NOZZLE ARRANGEMENT AND GAS TURBINE

(75) Inventor: Stephen Batt, Lincoln (GB)

(73) Assignee: SIEMENS AKTIENGESELLSCHAFT, München (DE)

( * ) Notice: Subject to any disclaimer, the term of this patent is extended or adjusted under 35 U.S.C. 154(b) by 857 days.

(21) Appl. No.: 13/395,480

(22) PCT Filed: Sep. 28, 2009

(86) PCT No.: PCT/EP2009/006978

§ 371 (c)(1),
(2), (4) Date: Mar. 12, 2012

(87) PCT Pub. No.: WO2011/035798

PCT Pub. Date: Mar. 31, 2011

(65) Prior Publication Data

US 2012/0177489 A1 Jul. 12, 2012

(51) Int. Cl.

| | |
|---|---|
| ***F01D 25/24*** | (2006.01) |
| ***F01D 11/00*** | (2006.01) |
| ***F01D 9/04*** | (2006.01) |
| ***F01D 25/12*** | (2006.01) |

(52) U.S. Cl.

CPC ..... *F01D 11/005* (2013.01); *F01D 9/041* (2013.01); *F01D 25/12* (2013.01); *F01D 25/243* (2013.01); *F01D 25/246* (2013.01); *F05D 2240/57* (2013.01); *F05D 2260/201* (2013.01)

(58) Field of Classification Search

CPC .. F01D 11/001; F01D 11/005; F01D 25/243; F01D 25/246; F01D 9/041; F01D 25/12; F05D 2240/57; F05D 2260/201

USPC ..... 415/116, 177, 220, 178

See application file for complete search history.

(56) References Cited

U.S. PATENT DOCUMENTS

| | | | | | |
|---|---|---|---|---|---|
| 3,965,066 | A | * | 6/1976 | Sterman et al. | 60/800 |
| 4,126,405 | A | | 11/1978 | Bobo | |
| 4,303,371 | A | * | 12/1981 | Eckert | 415/116 |
| 4,635,332 | A | | 1/1987 | Cederwall | |
| 4,798,514 | A | * | 1/1989 | Pask | 415/115 |
| 4,815,933 | A | * | 3/1989 | Hansel et al. | 415/189 |
| 5,118,120 | A | * | 6/1992 | Drerup et al. | 277/628 |
| 5,343,694 | A | * | 9/1994 | Toborg et al. | 60/796 |
| 5,407,319 | A | * | 4/1995 | Harrogate et al. | 415/115 |
| 5,470,198 | A | * | 11/1995 | Harrogate et al. | 415/115 |

(Continued)

FOREIGN PATENT DOCUMENTS

| | | | |
|---|---|---|---|
| EP | 0616111 | A1 | 9/1994 |
| WO | WO 0077348 | A1 | 12/2000 |

*Primary Examiner* — Sean J Younger

(57) ABSTRACT

A sealing element is provided for sealing a leak path between a radial outer platform of a turbine nozzle and a carrier ring for carrying said radial outer platform. The carrier ring has an axially facing carrier ring surface and the radial outer platform has an axially facing platform surface. The carrier ring surface forms a first sealing surface and the platform surface forming a second sealing surface. The first and second sealing surfaces is aligned in a plane with a radial gap between them. The sealing element includes a leaf seal adapted to cover the gap between the first and second sealing surfaces, and an impingement plate for allowing impingement cooling of a radial outer surface of a radial outer platform. The impingement plate is adapted to be fixed to the turbine nozzle. The sealing element may be part of a nozzle arrangement of a gas turbine.

8 Claims, 3 Drawing Sheets

(56) References Cited

U.S. PATENT DOCUMENTS

| | | | | |
|---|---|---|---|---|
| 6,269,628 | B1 * | 8/2001 | Gates | 60/804 |
| 6,382,906 | B1 * | 5/2002 | Brassfield et al. | 415/115 |
| 7,000,406 | B2 * | 2/2006 | Markarian et al. | 60/796 |
| 7,004,720 | B2 * | 2/2006 | Synnott et al. | 415/115 |
| 7,029,228 | B2 * | 4/2006 | Chan et al. | 415/1 |
| 2008/0118346 | A1 | 5/2008 | Liang | |
| 2008/0267768 | A1 * | 10/2008 | Dakowski et al. | 415/115 |
| 2010/0313571 | A1 * | 12/2010 | Steiger et al. | 60/772 |

* cited by examiner

GAS TURBINE NOZZLE ARRANGEMENT AND GAS TURBINE

CROSS REFERENCE TO RELATED APPLICATIONS

This application is the US National Stage of International Application No. PCT/EP2009/006978, filed Sep. 28, 2009 and claims the benefit thereof. All of the applications are incorporated by reference herein in their entirety.

FIELD OF INVENTION

The present invention relates to a gas turbine nozzle arrangement, to a gas turbine and to a sealing element for sealing a leak path between a radial outer platform of a turbine nozzle and a carrier ring for carrying said radial outer platform.

BACKGROUND OF INVENTION

Typically, gas turbine engines include a compressor for compressing air, a combustor for mixing the compressed air with fuel and igniting the mixture, and a turbine blade assembly for producing power. The turbine blade assembly usually comprises a number of rings of turbine blades between which nozzle arrangements comprising a number of guide vanes are located.

A nozzle arrangement typically comprises an outer carrier ring or support ring, an inner carrier ring or support ring, and a number of nozzle segments each typically comprising a radial outer platform, a radial inner platform and at least one vane extending from the radial outer platform to the radial inner platform. The nozzle arrangement forms an annular flow path for hot and corrosive combustion gases from the combustor.

Combustors often operate at high temperatures that may exceed 1350° C. Typical turbine combustor configurations expose turbine vane and blade arrangements to these high temperatures. As a result, turbine vanes and blades must be made of materials capable of withstanding such high temperatures. In addition, turbine vanes and blades often contain cooling systems for prolonging the lifetime of the vanes and the blades and for reducing the likelihood of failure as a result of excessive temperatures.

In order to prevent the platforms of the nozzle segments, which form the walls of the flow path for the hot and corrosive combustion gases, from damage due to the hot combustion gases the platforms are cooled with compressor air. However, the pressure of the compressor air used for cooling the platforms is higher than the pressure of the combustion gases flowing downstream of the nozzle arrangement. Moreover, the cooling air used for cooling the platforms, in particular their downstream ends, will be discharged into the flow path of the hot combustion gases. Hence, the flow of air into the flow path needs to be restricted to a minimum in order to preserve overall turbine efficiency. In order to restrict the flow of compressor air into the flow path of the hot combustion gas seals are provided between the radial outer platform of the nozzle segments and the outer carrier ring. Moreover, seals are provided between the radial inner platform of the nozzle segments and the inner carrier ring, mainly for preventing hot combustion gas from entering gaps between the platform and the carrier ring. Examples of such seals are disclosed in US 2008/0101927 A1, U.S. Pat. Nos. 6,641,144, 6,572,331, 6,637,753, 6,637, 751, US 2005/0244267 A1, EP 1 323 890 B1, EP 1 323 896 B1, EP 1 323 898 B1, U.S. Pat. No. 6,752,331, and US 2003/012398 A1.

EP 1 247 942 B1 is further disclosing a seal element for sealing a gas-path leakage-gap between components of a turbo machinery. This seal element consists of a plurality of elements made of sheet metal with of ceramic material. US 2005/0095123 A1does disclose a segmented seal between two longitudinally adjacent elements of a turbo machine.

U.S. Pat. No. 4,126,405 discloses a turbine nozzle with a leaf seal located between a vane forward outer rail and a combustor rear flange. The leaf seal is held in place by a plurality of pins by which it is fixed to the outer rail of the vane.

WO 00/77348 A1 describes a gas turbine with a reverse airflow duct between a combustion chamber and a first nozzle stage of the turbine. An inner duct wall of the reverse airflow duct is an integrally cast extension of a nozzle shroud and is covered by an impingement blade which allows for impingement cooling of the duct wall. A sealing lip is present between the duct wall and the inner combustor wall.

Known sealing devices do need a complex fastening means to mount them on a nozzle arrangement. All known sealing arrangements further do have in common that their construction, assembly, and manufacturing costs due to complexity are relatively high.

SUMMARY OF INVENTION

With respect to the mentioned prior art it is a first objective of the present invention to provide an advantageous gas turbine nozzle arrangement and an advantageous gas turbine. It is a second objective of the present invention to provide an advantageous sealing element for use in a gas turbine nozzle arrangement.

The above objectives are solved by the features of the independent claims. The depending claims contain further developments of the invention.

Furthermore, a sealing element is provided for sealing a leak path between a radial outer platform of a turbine nozzle and a carrier ring for carrying said radial outer platform, where the carrier ring has an axially facing carrier ring surface and the radial outer platform has an axially facing platform surface, the carrier ring surface forming a first sealing surface and the platform surface forming a second sealing surface, the first and second sealing surfaces being aligned in a plane with a radial gap between them. The sealing element comprises a leaf seal adapted to cover the gap between the first and second sealing surfaces and an impingement plate for allowing impingement cooling of a radial outer surface of the radial outer platform, the impingement plate being adapted to be fixed to the turbine nozzle. Such a sealing element is suitable for forming an inventive gas turbine nozzle arrangement and, hence, can be used to achieve the advantages which have been already been described with respect to the inventive nozzle arrangement.

The impingement plate and leaf seal may both be formed of sheet metal and connected by at least one connecting element.

In this respect, the leaf seal and an impingement plate may both be formed by different sheet metal sections of a single sheet metal element. The connecting element may then be formed by at least one intermediate bent sheet metal section of said sheet metal element. Alternatively, the impingement plate and the leaf seal may both be formed by different sheet metal plates. Then, the connecting element would be formed by at least one hinge element connecting the sheet metal plates forming the impingement plate and leaf seal.

In particular, the at least one connecting element may be made of an elastic sheet metal, so as to produce a spring force allowing the leaf seal to be spring biased against the first and second sealing surfaces.

To allow for easily assembling a cylindrical cover for the radial outer surfaces of the radial outer platforms in a gas turbine nozzle, the impingement plate part may form a cylinder section of a cylinder barrel.

An inventive gas turbine nozzle arrangement having an axial direction defining a flow direction of hot combustion gas there through and a radial direction comprises a carrier ring and nozzle segments each having an outer platform forming an outer wall segment of a flow channel for the hot combustion gas and at least one guide vane extending from the outer platform radially inwards. The outer platforms each are connected to the carrier ring which has an axially facing carrier ring surface. Moreover, each outer platform has an axially facing platform surface. The carrier ring surface forms a first sealing surface and the platform surface forms a second sealing surface. Carrier ring surface and platform surface are aligned to each other in a plane and are located with a radial gap between each other. Each outer platform comprises a radial outer surface with an impingement plate for allowing impingement cooling of the radial outer surface. A sealing element is provided which comprises an axially facing leaf seal that is combined with the impingement plate, the leaf seal abutting against both the first and second sealing surfaces so as to overlap the gap.

By combining the leaf seal with the impingement plate it becomes possible to seal the potential air leak path between the nozzle and the carrier ring with little complexity and cost. In particular, it becomes possible to fix the leaf seal by the impingement plate part of the seal, for which a suitable fixing structure is already present. Hence, it is not necessary to provide a special, and possibly complex, fixing structure for a leaf seal sealing the mentioned leak path.

Preferably, the leaf seal is spring biased against the first and second sealing surfaces so that, at the one hand, a good sealing performance can be assured and, on the other hand, fixation by clamping can be realised.

The impingement plate and leaf seal may both be formed of a sheet metal connected by at least one connecting element. This allows for a simple and lightweight construction. The at least the connecting element may, in particular, be made of an elastic sheet metal, so as to produce the spring force spring biasing the leaf seal sealing surface against the first and second sealing surfaces. In a special implementation of such a construction, the impingement plate and the leaf seal are both formed by different sheet metal sections of a single sheet metal element, and the connecting element is formed by at least one intermediate bent sheet metal section of said sheet metal element. In an alternative implementation, the impingement plate and the leaf seal are both formed by different sheet metal plates, and the connecting element is formed by at least one hinge element connecting the sheet metal plates forming the impingement plate.

The impingement plate may form a cylinder section of a cylindrical cover around the radial outer surfaces of the outer platforms, which allows for fully covering the radial outer surfaces by a number of individual sealing/impingement plate arrangements.

An inventive gas turbine comprises at least one inventive gas turbine nozzle arrangement.

BRIEF DESCRIPTION OF THE DRAWINGS

Further features, properties, and advantages of the present invention will become clear from the following description of preferred embodiments in conjunction with the attached drawings.

DETAILED DESCRIPTION OF INVENTION

Figure 1:
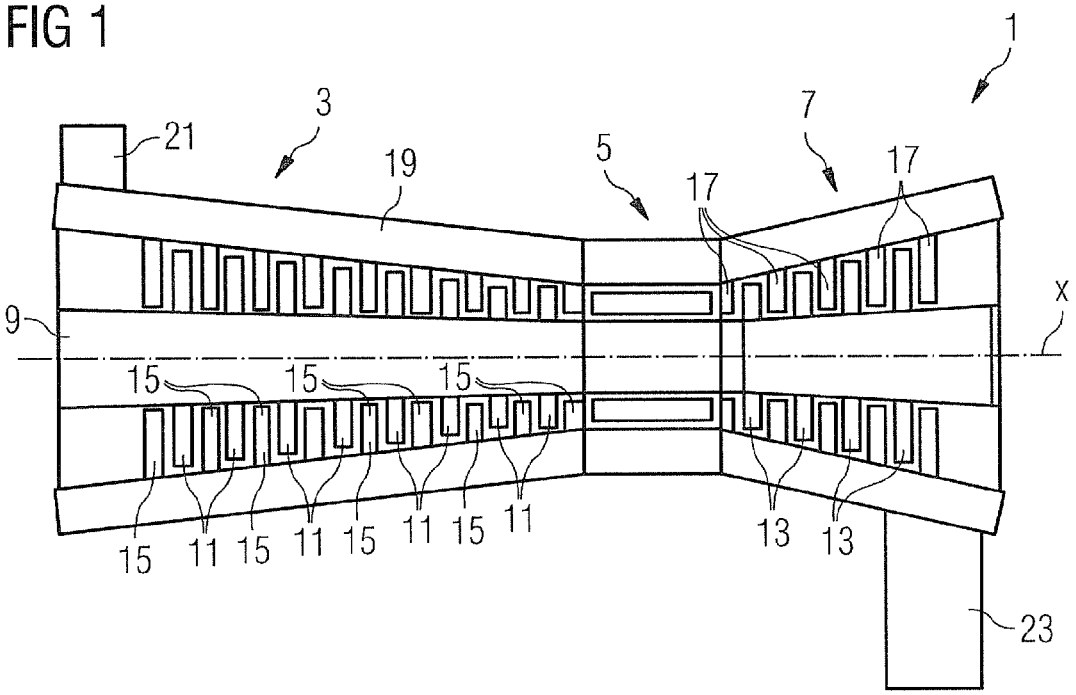
FIG. 1 shows a gas turbine engine in a highly schematic view.

FIG. 1 shows, in a highly schematic view, a gas turbine engine 1 comprising a compressor section 3, a combustor section 5 and a turbine section 7. A rotor 9 extends through all sections and carries, in the compressor section 3, rings of compressor blades 11 and, in the turbine section 7, rings of turbine blades 13. Between neighbouring rings of compressor blades 11 and between neighbouring rings of turbine blades 13, rings of compressor vanes 15 and turbine vanes 17, respectively, extend from a housing 19 of the gas turbine engine 1 radially inwards towards the rotor 9. Rotor 9 is rotating around its rotation axis X.

In operation of the gas turbine engine 1 air is taken in through an air inlet 21 of the compressor section 3. The air is compressed and led towards the combustor section 5 by the rotating compressor blades 11. In the combustor section 5 the air is mixed with a gaseous or liquid fuel and the mixture is burnt. The hot and pressurised combustion gas resulting from burning the fuel/air mixture is fed to the turbine section 7. On its way through the turbine section 7 the hot pressurised gas transfers momentum to the turbine blades 13 while expanding and cooling, thereby imparting a rotation movement to the rotor 9 that drives the compressor and a consumer, e.g. a generator for producing electrical power or an industrial machine. The rings of turbine vanes 17 function as nozzles for guiding the hot and pressurised combustion gas so as to optimise the momentum transfer to the turbine blades 13. Finally, the expanded and cooled combustion gas leaves the turbine section 7 through an exhaust 23.

Figure 2:
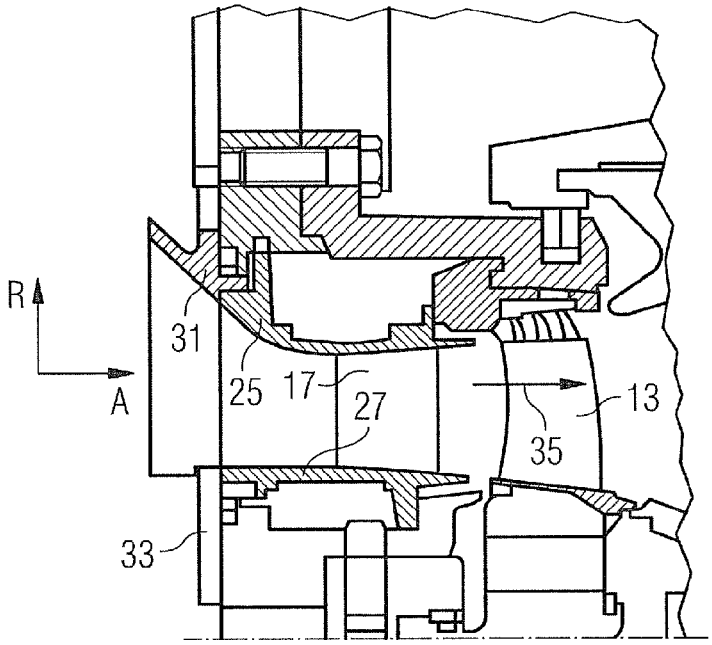
FIG. 2 shows an example for a turbine entry of a gas turbine engine.

The entrance of the turbine section 7 is shown in more detail in FIG. 2. The figure shows the first ring of turbine blades 13 and a first ring of turbine vanes 17. The turbine vanes 17 extend between radial outer platforms 25 and radial inner platforms 27 that form walls of a flow path for the hot pressurised combustion gas together with neighbouring turbine components 31, 33 and with platforms of the turbine blades 13. Also shown in the figure is the axial direction A and the radial direction. R of the rings of turbine vanes and blades. Combustion gas flows through the flow path in the direction indicated in FIG. 2 by the arrow 35, i. e. substantially in the axial direction A. The turbine vanes 17, which form nozzle segments together with the outer and inner platform 25, 27 between which they extend, are held in place by an outer carrier ring and an inner carrier ring to which the outer platforms 25 and the inner platforms 27, respectively, are connected. The outer cattier ring, the inner carrier ring and the nozzle segments together form a nozzle arrangement of the turbine.

Note, that although each single guide vane 17 of the present embodiment forms a nozzle segment together with the outer platform 25 and the inner platform 27 other forms of nozzle segments may be possible. In an exemplary alternative nozzle segment, the outer platform and an inner platform could extend over a larger ring segment than in the depicted embodiment so that they could have a number of vanes, e.g., two or three vanes, extending between them. However, platforms extending over a smaller ring segment and having only one vane extending between them are advantageous as thermal expansion during gas turbine operation leads to less internal stress than with platforms extending over a larger ring segment. Moreover, an inner carrier ring is not necessary in any case.

Figure 3:
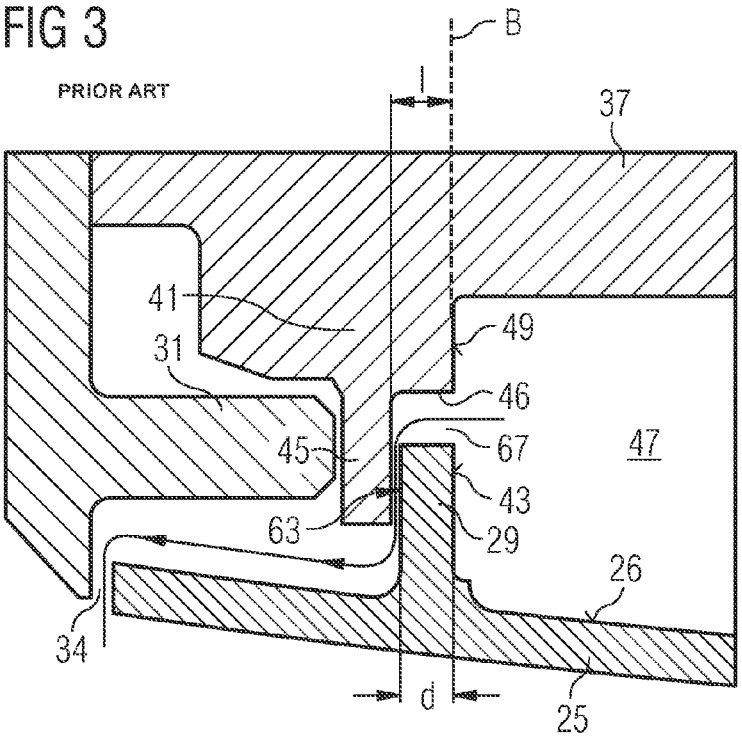
FIG 3 PRIOR ART
FIG. 3 shows a section of a nozzle arrangement without inventive sealing element.

FIG. 3 shows a section of a nozzle arrangement without an inventive sealing element 71 for demonstrating a leakage path from a compressor air reservoir 47 to the flow path formed by the nozzle arrangement that is present between the carrier ring 37 and the radial outer platform 25.

The outer carrier ring 37 comprises a ring section 41 with a protrusion 45 which protrudes radially inwards from the ring section 41 towards the outer platform 25. The outer platform 25 comprises a rail 29 which protrudes radially outwards from the outer platform 25 towards the ring section 41 of the carrier ring 37. A shoulder 46 is formed between the ring section 41 and the protrusion 45 with the length 1 which corresponds substantially to the thickness d of the rail 29 of the outer platform 25. The protrusion 45 from the ring section 41 and the rail 29 serve to fix the radial outer platform 25 to the carrier ring 37, e.g., by means of bolts or screws extending through the protrusion 41 and the rail 29, as it is known from the state of the art.

A gap 67 remains between the shoulder 46 of the ring section 37 and the rail 29 when the outer platform 25 is fixed to the carrier ring 37. Furthermore, a clearance 67 remains between the rail 29 and the protrusion 41 in order to allow for movement of both relative to each other in response to different thermal expansions. Moreover, a compressor air reservoir 47, which is in flow connection with the compressor exit, delivers compressor air to one or more internal passages of the guide vane 17 for cooling the same. In addition, the compressor air is used for impingement cooling of the outer platform 25—to be more precise, the radial outer surface 26 of the outer platform 25—by use of an impingement plate (not shown in FIG. 3) which is fixed upstream to the radial outer surface 26 of the outer platform 25. In this configuration, the gap 63 and the clearance 67 form a leak path through which compressor air can flow in direction of the arrow 65 from the compressor air reservoir 47 into the flow path of the nozzle.

There may be a neighbouring turbine component 31 located upstream in the flow direction of the flow path through the nozzle. However, the leak path would still be present, as shown in FIG. 3, since a gap 34 would also be present between the radial outer platform 25 and the neighbouring turbine component 31 to allow for different thermal expansions. Hence, the leak path would only be extended but not closed by the presence of the neighbouring turbine component 31.

Figure 4:
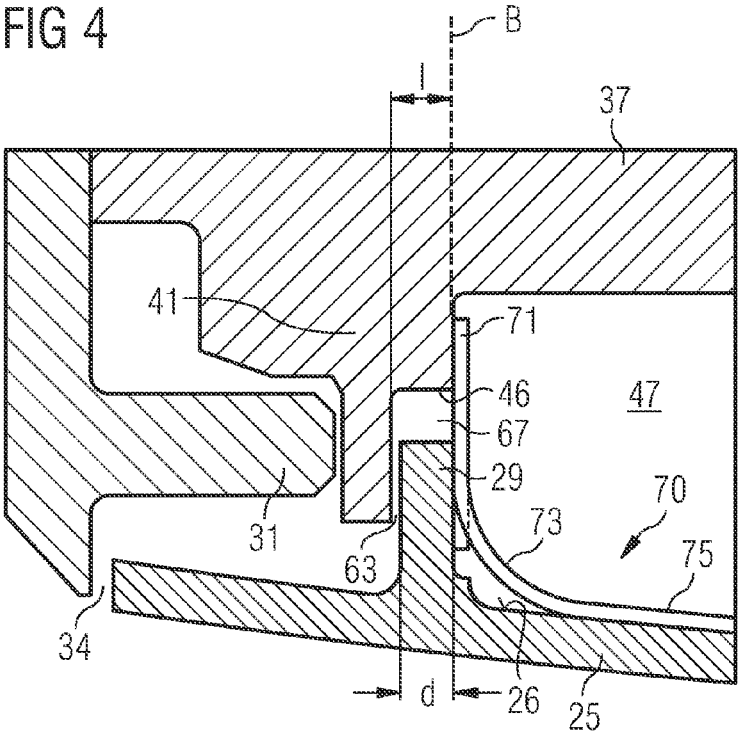
FIG. 4 shows the section of FIG. 3 with inventive sealing element.

FIG. 4 shows the section of the inventive nozzle arrangement shown in FIG. 3 with an inventive sealing element 71.

The rail 29 of the outer platform 25 comprises a platform surface 43 facing in axial direction A of the nozzle segment (as indicated in FIG. 3). Likewise, the shoulder 46 in the ring section 41 of the carrier ring 37 comprises a carrier ring surface 49 (see FIG. 3) also in axial direction A of the nozzle segment. The carrier ring surface 49 and the platform surface 43 form first and second sealing surfaces, respectively. These first and second sealing surfaces 43, 49 are aligned in a plane B. Plane B may be a plane perpendicular to the axis A.

Figure 5:
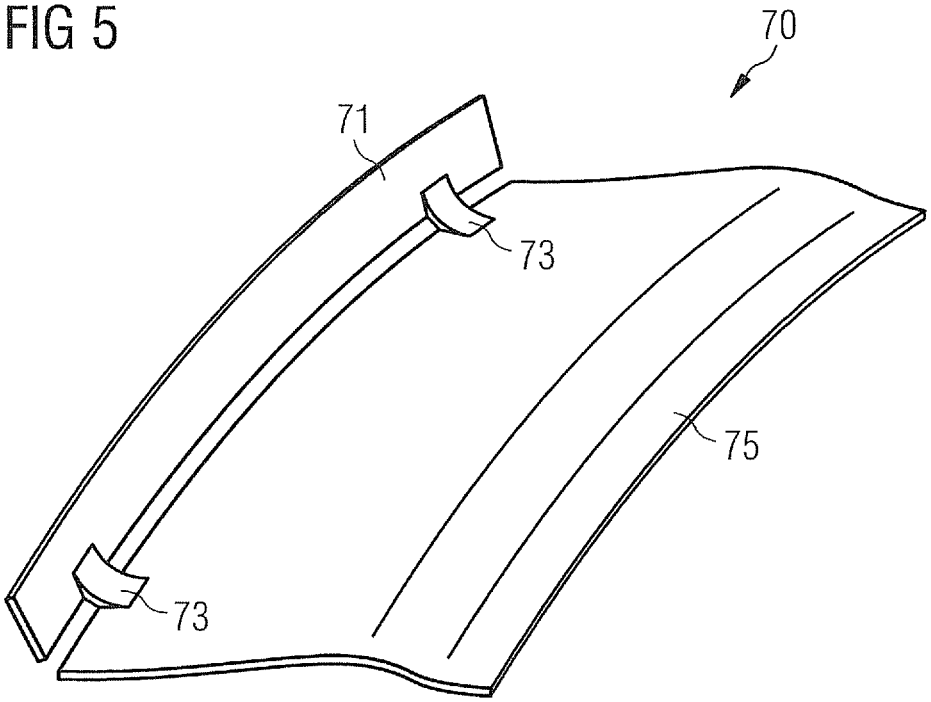
FIG. 5 shows a perspective view of an inventive sealing element.

The sealing element 70 of the present invention is shown in FIG. 5 in a perspective view. It comprises a leaf seal 71 and the impingement plate 75 mentioned above. Note that the impingement jet forming holes which are present in the impingement plate 75 are not shown in the figure. Both the impingement plate 75 and the leaf seal 71 are made from sheet metal and connected to each other by at least one connecting element which consists, in the present embodiment, of two hinge sections 73 that are made of a resilient bent sheet metal. Due to the hinge section 73 being resilient spring biasing the leaf seal 71 against the sealing surfaces 43, 49 is possible. Note, that the thickness, the width, and the number of the hinge sections 73 may be chosen so as to set a desired spring force and to reduce the thermal stresses to leaf seal 71 and impingement plate 75.

Combining the leaf seal 71, the impingement plate 75 by the hinge sections 73 to form the sealing element 70 can be done by forming the leaf seal 71, the impingement plate 75 and the hinges from a single piece of sheet metal by suitably cutting and bending the piece of sheet metal. Forming the leaf seal 71, the impingement plate 75, and the hinge sections 73 from a metal sheet may done, e.g., by a known compression method.

Alternatively, combining the leaf seal 71, the impingement plate 75 by the hinge sections 73 to form the sealing element 70 can be done by forming at least two to the leaf seal 71, the impingement plate 75, and the hinge sections 73 out of different pieces of metal and combining them afterwards to form the sealing element 70. Combining the different pieces of metal can be done by various means like, e.g., welding, soldering, screwing, rivetting etc.

The impingement plate section 75 of the sealing element 70 is formed as a cylinder barrel segment. Hence it can be mounted so as to surround and cover the outer surface of the outer platforms 25 of a nozzle arrangement.

With the design of the inventive sealing element 70, the pressurised compressor air in the air reservoir 47 pushes the leaf seal 71 towards the sealing surfaces 43, 49 so as to provide for a tight sealing, even if the leaf seal 71 is not spring biased against the sealing surfaces 43, 49. Hence the consumption of fresh air is reduced and the gas turbine is able to run with a higher efficiency.

The invention claimed is:

1. A gas turbine nozzle arrangement having an axial direction defining a flow direction of hot combustion gas there through and a radial direction, the nozzle arrangement comprising:

a plurality of nozzle segments each having an outer platform forming an outer wall segment of a flow channel for the hot combustion gas, and at least one guide vane extending from the outer platform radially inwards, a carrier ring securely fastened to the outer platforms that carries the outer platforms in radial directions, and a sealing element, wherein the carrier ring includes a radially inward protrusion having an axially facing carrier ring surface;

each outer platform has an axially facing platform surface and a radial outer surface;

the carrier ring surface forms a first sealing surface and the platform surface forms a second sealing surface, wherein the carrier ring surface and the platform surface are aligned coplanar to each other along a plane perpendicular to the axial direction and are located with a radial gap between each other;

the sealing element comprises a leaf seal adapted to cover the gap between the first and second sealing surfaces and an impingement plate for allowing impingement cooling of the radial outer surface of the outer platform, the impingement plate being aligned along the radial outer surface and is fixed to the radial outer surface;

the leaf seal of the sealing element abuts against both the first and second sealing surfaces so as to overlap the gap; and wherein the leaf seal and the impingement plate are connected by at least one connecting element, wherein the at least one connecting element is made of an elastic sheet metal, so as to produce a spring force spring biasing the leaf seal against the first and second sealing surfaces.

2. The gas turbine nozzle arrangement as claimed in claim 1, wherein the impingement plate and leaf seal are both formed of sheet metal and connected by the at least one connecting element.

3. The gas turbine nozzle arrangement as claimed in claim 1, wherein the leaf seal and the impingement plate both are formed by different sheet metal sections of a single sheet metal element and are connected by the at least one connecting element, wherein the at least one connecting element is formed by at least one intermediate bent sheet metal section of the sheet metal element.

4. The gas turbine nozzle arrangement as claimed in claim 1, wherein the impingement plate and leaf seal are both formed by different sheet metal plates and are connected by the at least one connecting element, wherein the at least one connecting element is formed by at least one hinge element interconnecting the sheet metal plates forming the impingement plate and leaf seal.

5. The gas turbine nozzle arrangement as claimed in claim 1, wherein the impingement plate forms a cylinder section of a cylindrical barrel.

6. The gas turbine nozzle arrangement as claimed in claim 1, wherein the leaf seal is spring biased against the first and second sealing surfaces.

7. The gas turbine nozzle arrangement as claimed in claim 1, wherein the impingement plate forms a cylinder section of a cylindrical cover around the radial outer surfaces of the outer platforms.

8. A gas turbine comprising at least one gas turbine nozzle arrangement as claimed in claim 1.

* * * * *